US005190297A

United States Patent [19]

Jessen et al.

[11] Patent Number: 5,190,297

[45] Date of Patent: Mar. 2, 1993

[54] GAME APPARATUS

[75] Inventors: Lewis Jessen, Scarborough; Sam Sgro, Thornhill, both of Canada

[73] Assignee: Bluffers Beware Limited, Scarborough, Canada

[21] Appl. No.: 860,061

[22] Filed: Mar. 30, 1992

Related U.S. Application Data

[63] Continuation-in-part of Ser. No. 550,551, Jul. 10, 1990, abandoned.

[51] Int. Cl.[5] ..... A63F 1/00; A63F 1/10

[52] U.S. Cl. ..... 273/296; 273/300; 273/148 A; 434/327; 434/429

[58] Field of Search ..... 273/429, 430, 296–308, 273/292, 293, 273, 148 R, 148 A, 150; 434/167, 176, 428, 429, 430, 347, 365; D21/54, 55, 57; 40/539, 155, 156, 530

[56] References Cited

U.S. PATENT DOCUMENTS

| | | | |
|---|---|---|---|
| 678,791 | 7/1901 | Ford | 273/296 |
| 1,138,534 | 5/1915 | Brister | 273/308 X |
| 1,263,664 | 4/1918 | Hanada | 273/296 |
| 1,711,199 | 4/1929 | Hatch | 40/156 |
| 1,755,853 | 4/1930 | Waring | 434/167 |
| 2,054,277 | 4/1934 | Otterson | 40/155 X |
| 2,154,891 | 4/1939 | Dodge | 273/296 |
| 2,354,424 | 12/1949 | Kirk | 273/296 |
| 2,824,389 | 2/1958 | Orebaugh | 434/167 |
| 3,093,912 | 6/1963 | Beauvais | 434/276 |
| 3,524,645 | 8/1970 | Breslow | 273/292 |
| 3,593,431 | 7/1971 | Candido | 434/167 |
| 3,929,332 | 12/1975 | Kidd | 273/150 X |
| 4,289,315 | 9/1981 | O'Barr | 273/148 A X |
| 4,298,200 | 11/1981 | Kanbar | 273/148 A X |
| 4,588,865 | 12/1985 | Isgar | 273/148 A |
| 4,921,427 | 5/1990 | Dunn | 434/340 |

FOREIGN PATENT DOCUMENTS

| | | | |
|---|---|---|---|
| 249963 | 4/1926 | United Kingdom | 40/156 |
| 2153240 | 8/1985 | United Kingdom | 273/292 |

*Primary Examiner*—V. Millin
*Assistant Examiner*—Sebastiano Passaniti

[57] ABSTRACT

The game apparatus of the present invention comprises a plurality of game cards with each game card having an indicia bearing front and rear face. The front face of each card includes a pictorial representation and the rear face has a worded description of that particular pictorial representation. The game apparatus further includes a card support for supporting the cards individually in a generally upright position with the pictorial representation on the front face of each card in an exposed position and the worded description on the rear face of each card being viewable from the rear of the card support without having to remove the card from the card support. The players of the game include one guesser at least one bluffer and a truth teller. The bluffers and the truth teller view the back of the card. The bluffers then give an inaccurate statement and the truth teller gives an accurate statement as to the pictorial representation on the card. The guesser is awarded points by his/her ability to determine who is a bluffer and who is a truth teller. In order to make this distinction another feature of the game is the provision of player identifying members, all of which appear identical to the guesser and which specifically identify to the other players who is a bluffer and who is a truth teller. The player identification members are distributed at random for each round of play.

5 Claims, 7 Drawing Sheets

FIG. 4

A CAMERA MOUNT DESIGNED FOR FILMING A DOWNHILL SKI RUN AT UP TO 60 mph.

25

23

TRUTHTELLER I.D. BOX

13

| SINGLE PLAY | #1 | #2 | #3 | TEAM PLAY | #1 | #2 |
|---|---|---|---|---|---|---|
| 3 PLAYERS | 2 | 7 | | 2 PER TEAM | 6 | |
| 4 PLAYERS | 3 | 6 | | 3 PER TEAM | 5 | |
| 5 PLAYERS | 4 | 5 | | 4 PER TEAM | 4 | |
| 6 PLAYERS | 5 | 4 | | 5 PER TEAM | 3 | |
| 7 PLAYERS | 6 | 3 | | 6 PER TEAM | 2 | |
| 8 PLAYERS | 7 | 2 | | | | |

27

FIG. 5

31

33

29

| Number of rounds. | PLAYER 1 | PLAYER 2 | PLAYER 3 | PLAYER 4 | PLAYER 5 | PLAYER 6 | PLAYER 7 | PLAYER 8 | PLAYER 9 | PLAYER 10 |
|---|---|---|---|---|---|---|---|---|---|---|
| 1 | | | | | | | | | | |
| 2 | | | | | | | | | | |
| 3 | | | | | | | | | | |
| 4 | | | | | | | | | | |
| 5 | | | | | | | | | | |
| 6 | | | | | | | | | | |
| 7 | | | | | | | | | | |
| 8 | | | | | | | | | | |
| 9 | | | | | | | | | | |
| 10 | | | | | | | | | | |
| 11 | | | | | | | | | | |
| 12 | | | | | | | | | | |
| 13 | | | | | | | | | | |
| 14 | | | | | | | | | | |
| 15 | | | | | | | | | | |
| 16 | | | | | | | | | | |
| 17 | | | | | | | | | | |
| 18 | | | | | | | | | | |
| 19 | | | | | | | | | | |
| 20 | | | | | | | | | | |
| 21 | | | | | | | | | | |
| 22 | | | | | | | | | | |
| 23 | | | | | | | | | | |
| 24 | | | | | | | | | | |
| 25 | | | | | | | | | | |

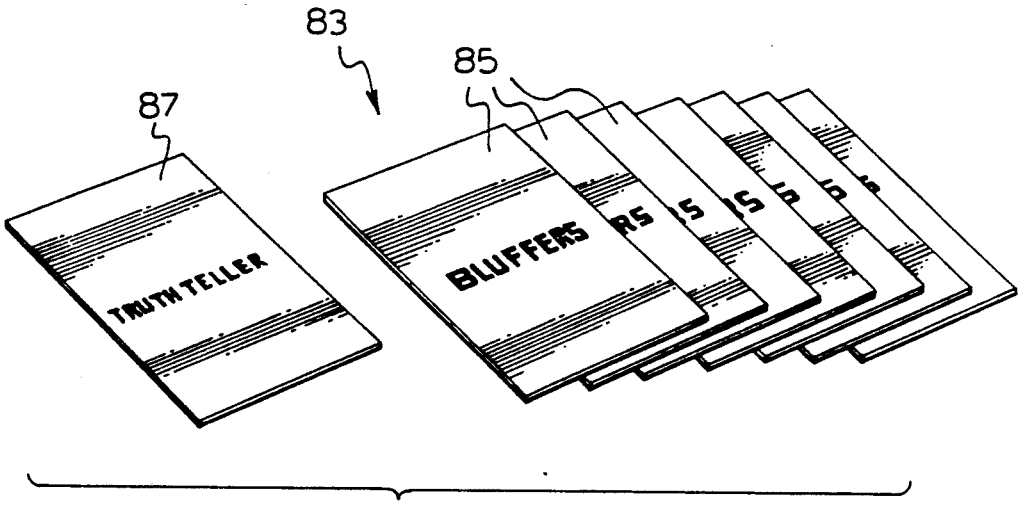
FIG.11.
FIG.12.
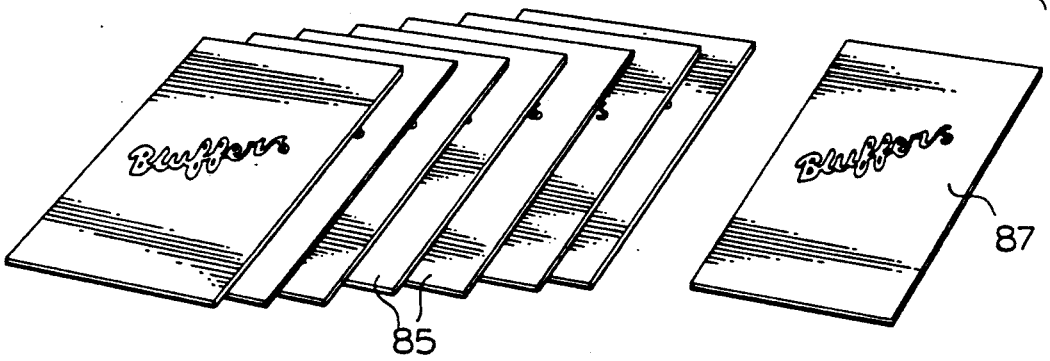
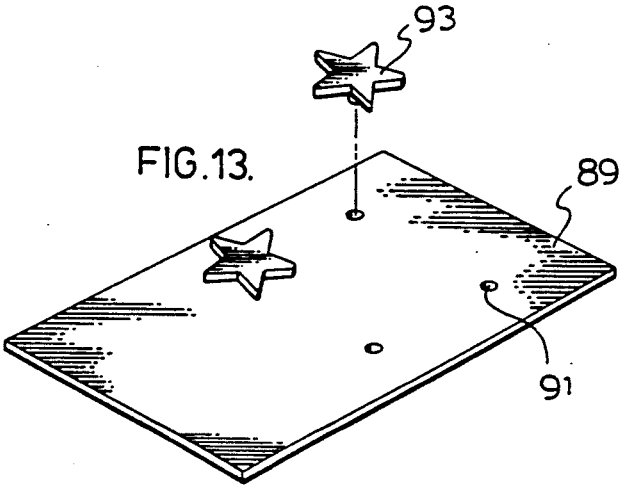
FIG.13.

GAME APPARATUS

This is a continuation in part of now abandoned U.S. patent application Ser. No. 07/550,551 filed Jul. 10, 1990, now abandoned.

FIELD OF THE INVENTION

The present invention relates to game apparatus based on game cards which have information on both the front and the rear surface of the game cards and a card support for holding the game cards generally upright for easy viewing of the game cards. The game players include a guesser, a truth teller and at least one bluffer. Additionally forming part of the game is means for identifying the truth teller from the bluffers without alerting the guesser as to the distinction.

BACKGROUND OF THE INVENTION

Over the last few decades, there have been different phases of interest with respect to card played games. For many years, fairly straightforward games where the players simply rolled dice and moved markers along a board game based on the roll of the dice were very popular. However interest in this type of game seems to have now faded.

More recently, the typical popular type of card game was one in which the participants moved around the board according to their ability to answer skill testing questions. Again, these types of games are not as popular as they once were, possibly because the players often found it frustrating when they were unable to answer the skill testing question.

There seems to now be a need for a new type of card playing game which does not simply rely on the luck of the roll of the dice and further which does not require a need to answer factual questions.

SUMMARY OF THE PRESENT INVENTION

The present invention provides a game apparatus for playing a game which is not simply based on luck and which allows the participants or players to use their imaginations without having to necessarily know factual information. The entire game is based on a plurality of game cards, each one of which includes indicia on both its front and its rear face. The front face of each game card bears a pictorial representation of a certain object and the rear face includes a worded description of the pictorial representation.

The game apparatus further includes card support means for supporting the cards individually in an upright or at least a generally upright position with the pictorial representation on the front face of each card in an exposed position and the worded description at the rear face of each card being viewable from the rear of the card support means without having to remove the card from the card support means.

According to the rules of the game, one of the players is a guesser while the remaining players are describers. All of the describers view both the front and the rear face of the card. The guesser only views the front face of the card. One of the describers, a truth teller, provides a correct description of the object of the pictorial representation while the remaining describers, the bluffers, provide incorrect descriptions. The guesser attempts to determine which one of the describers has provided the accurate description.

In order to select bluffers and the truth teller, the game includes player identification means that identifies which players will be bluffers and which player will be the truth teller. The player identification means is not discernible by the guesser and is used to provide a random selection of bluffers and truth tellers for each round of play.

BRIEF DESCRIPTION OF THE DRAWINGS

The above as well as other advantages and features of the present invention will be described in greater detail according to the preferred embodiments of the present invention in which;

FIG. 4 is a rear view of one of the cards from the deck of FIG. 2;

FIG. 5 is a plan view of a score card used for keeping score for the game set up of FIG. 1;

FIG. 11 is a bottom perspective view of a plurality of player identification members according to a preferred embodiment of the present invention;

FIG. 12 is a top perspective view of the player identification members of FIG. 11;

FIG. 13 is a top perspective view of a score-keeping member according to a preferred embodiment of the present invention.

DETAILED DESCRIPTION ACCORDING TO THE PREFERRED EMBODIMENTS OF THE PRESENT INVENTION

Figure 1:
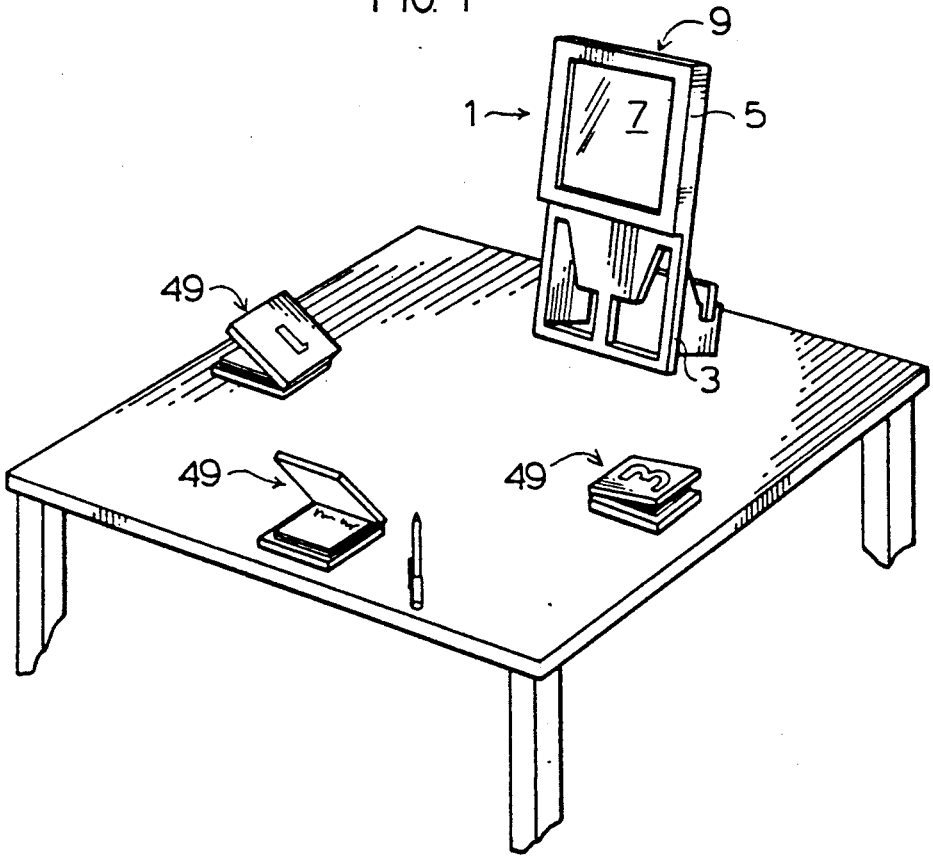
FIG. 1 is a perspective view of a game apparatus set up according to a preferred embodiment of the present invention.
Figure 2:
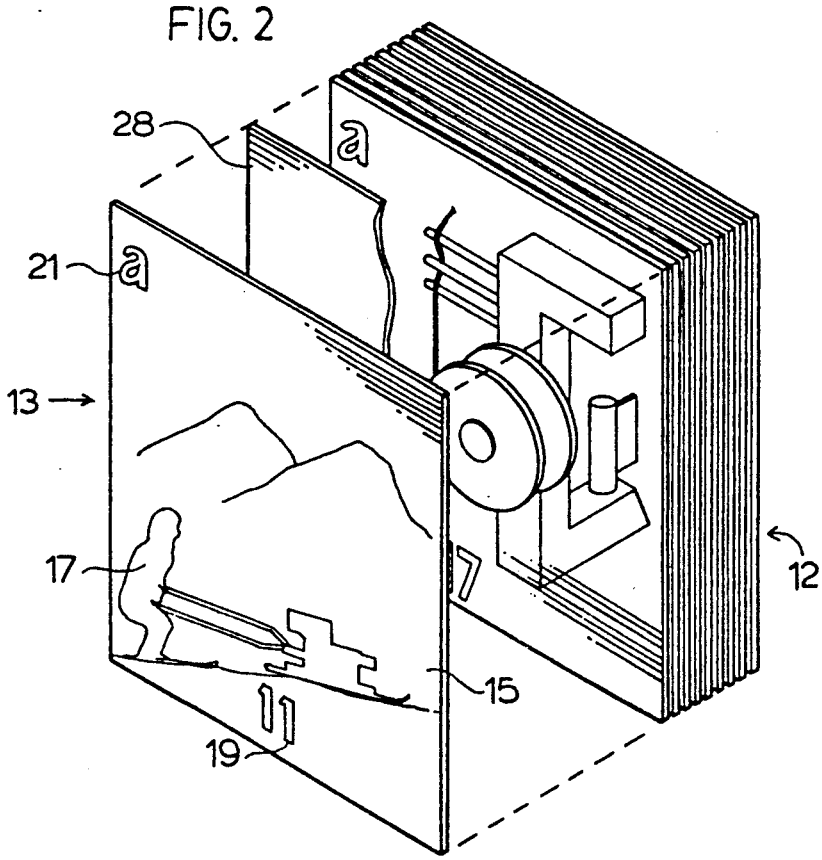
FIG. 2 is a front perspective view of a deck of cards used for playing the game of FIG. 1.

FIGS. 1 and 2 show the materials or items provided in one embodiment of the game apparatus of the present invention.

In particular, this game apparatus includes card support means generally indicated at 1 which is in the form of an upright card stand. This card stand includes a lower leg region 3 and an upper card holding region defined by a frame 5 having a window region 7. A card slot 9 is provided in the frame 5.

Figure 3:
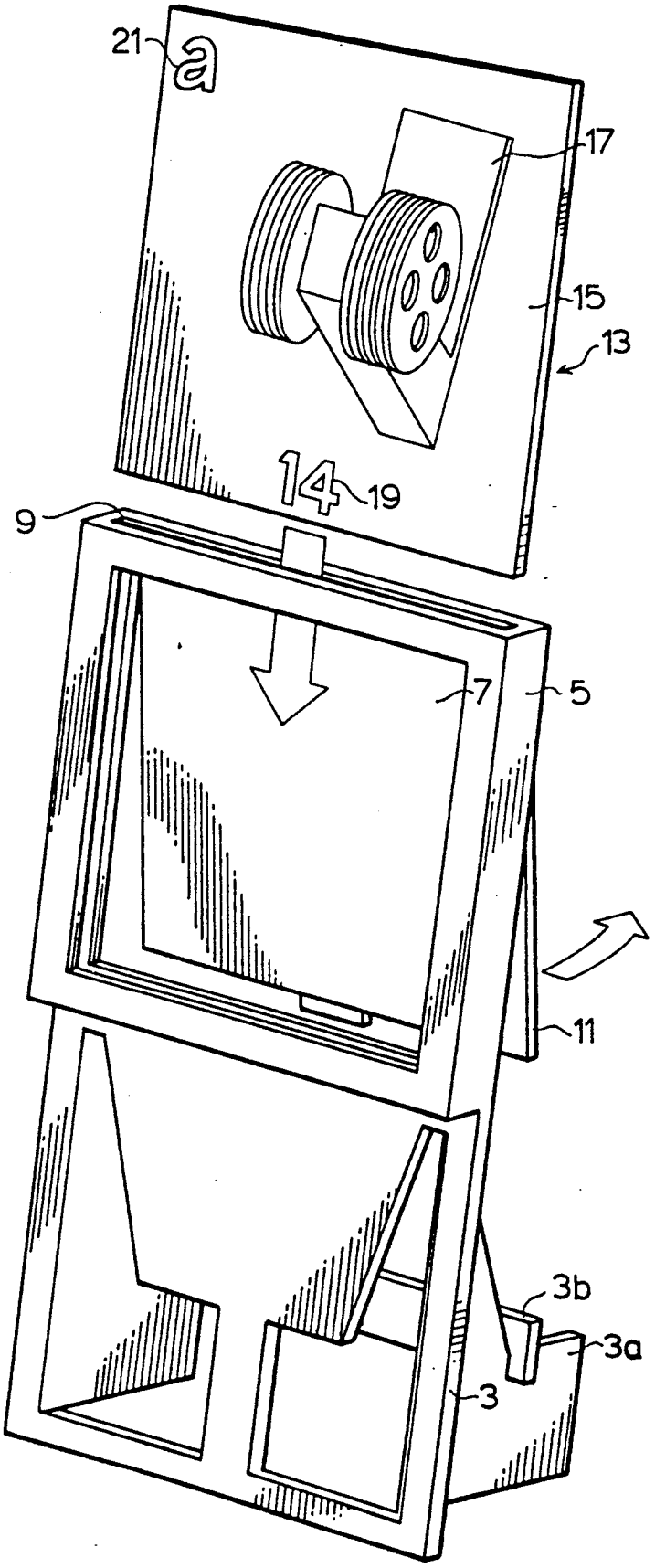
FIG. 3 is an enlarged front perspective view of the card support of FIG. 1 showing the insertion of one of the cards from the deck of FIG. 2 into the card support.

As seen in FIG. 3 of the drawings, the back of the card support includes a movable flap 11 which allows viewing of the rear surface of any one of the cards inserted into the card support as described later in detail.

Continuing with FIG. 3, it will be seen that the lower leg region 3 comprises a pair of leg extension members 3*a* which are movable to and from a rearwardly extending position as shown in FIG. 3. They are held in their rearwardly extending position by means of a locking bar 3*b*. However, by removing the locking bar 3*b* the leg extensions 3*a* can be folded flat for packaging of the card stand.

FIG. 2 shows deck 12 of a plurality of individual cards, one of which is indicated at 13. Each of the cards 13 has a front face 15 with a pictorial illustration or representation 17 on that front face. Further provided on the front face of each of the cards is a betting number 19 as well as a card series identification letter 21. This letter 21 identifies cards of the same series which is useful when purchasing new cards so that the owner of the game does not duplicate his or her purchase.

FIG. 4 shows the rear face 23 of card 13. This rear face includes an accurate worded description 25 of the pictorial representation on the front face of the card. The term worded description obviously covers the description in printed, typed, etc. format.

Also provided on the rear face of the card is player identification information indicated at 27. The purpose of this player identification information will be described later in detail.

As best seen in FIG. 3 of the drawings, any one of the cards 13 is inserted into the card support by fitting it through the slot 9 in the frame 5 to seat relative to window 7 such that the pictorial representation 17 and the betting number 19 can easily be seen at the front of the card support. Note that the lower leg region 3 elevates the frame 5 such that the card which sits in a generally upright position is easily seen by all of the players in the game.

One of the key features of the present invention is that window region 7 opens to both the front and the back of the card support so that the card support does not block access to the rear face of the card held in the support. The card support does however include the rear flap 11 but this flap is liftable as shown in FIG. 3 to allow viewing of the rear surface of the card without having to remove the card from the card support As earlier described, there ar two categories of players in the game. Firstly, there is a guesser and secondly, there are a number of describers. The describers are themselves broken down into two groups including one or more bluffers and a single truth teller. The player identification information 27 on the rear face of the card 13 is used to indicate which one of the players is the truth teller. This is a random selection for each card inserted and is information that is not available to the guesser.

The pictorial representations on the cards represent relatively obscure or unknown objects. All of the players view the front face of the card and the describers also view the rear face of the card by lifting flap 11 so that each and everyone of them knows the accurate description for the object. However, only the truth teller provides this accurate description while the remaining describers provide a made up description. The guesser then attempts to determine which one of the descriptions is the accurate description.

As earlier described, each one of the cards includes a betting number on its front face. The game apparatus further includes a plurality of writing and betting pads 49 shown in FIG. 1 of the drawings. Each of the players can bet a certain number of points on each round up to a maximum number of points as determined by the betting number on the card. The bet is made on the players belief as to whether or not the guesser can be fooled by the various descriptions provided by the describers.

FIG. 5 shows the score card for recording the betting performance of the players over a series of rounds and in this particular case, 25 rounds. At the end of 25 rounds, the winner is then determined according to the number of betting points accumulated over those 25 rounds.

The use of the rear movable flap 11 on the card support adds to the intrigue of the game and helps in hiding the correct answer from the guesser. It further hides the actual description from the describers after their initial inspection of this information and each of the describers then provides a description of the object. This avoids the truth teller from giving a word for word description from the rear face of the card which in some cases, could make it very obvious to the guesser as to which one of the descriptions is the correct description, i.e. both the truth teller and the bluffers can add some imagination to their description as long as the truth teller maintains an accurate description of the pictorial representation.

The game as described above is very interesting in that it allows the players and in particular, the bluffers to use their imaginations and to come up with some very imaginative descriptions of the object represented by the pictorial illustration. Furthermore, although the game is challenging, it does not require that the guesser has to be aware of factual information for all rounds of the game thereby avoiding the frustration that some players have in other types of games where this is a requirement.

Figure 6:
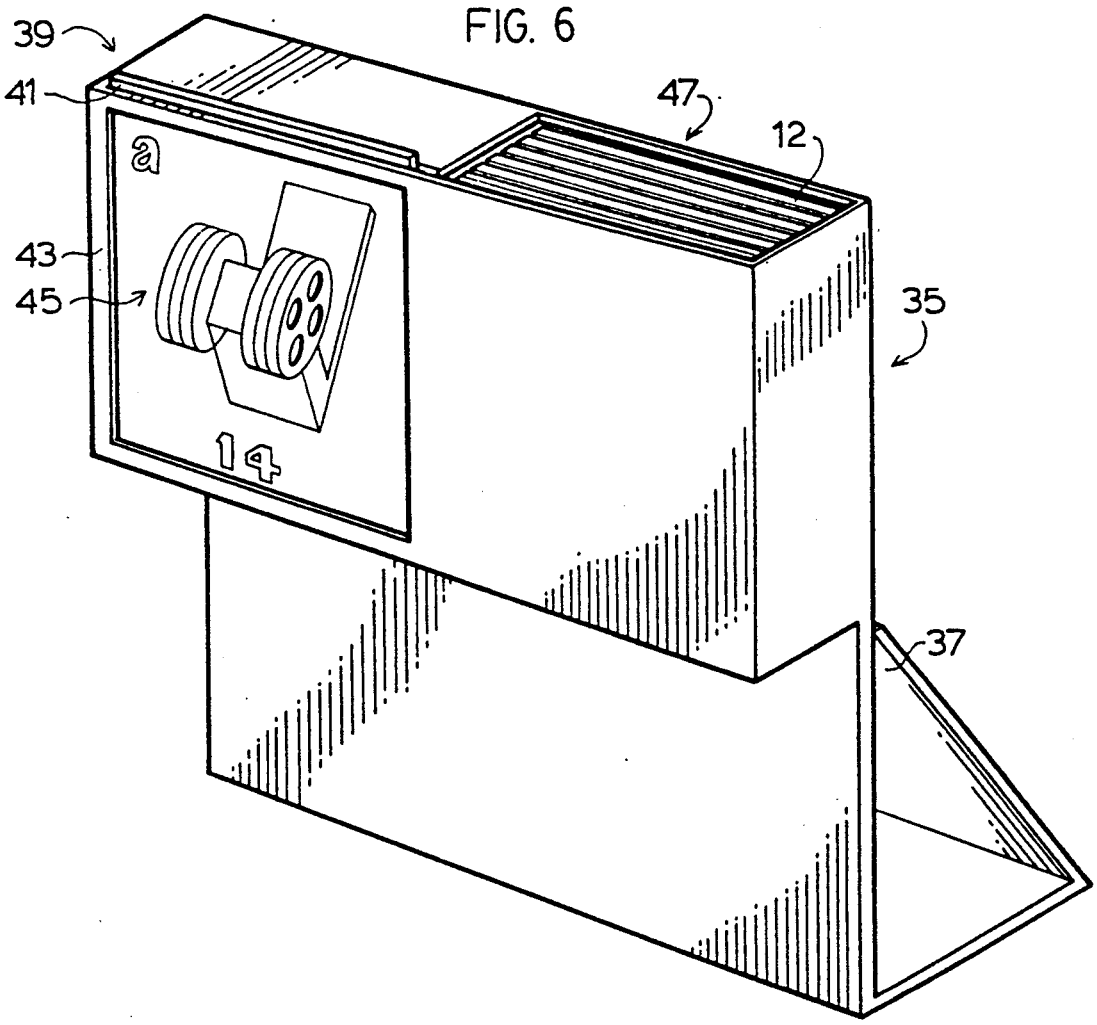
FIG. 6 is a front perspective view showing a card support and deck of cards according to a further preferred embodiment of the present invention.

FIG. 6 of the drawings shows a further preferred embodiment card support generally indicated at 35. This card support includes a lower leg region 37 and an upper region generally indicated at 39. Region 39 comprises a frame 43 and a window region 45 with a card slot 41 through from 43. In addition, the upper region includes a card deck receiving region 47 for receiving the entire deck of cards 12 as shown. This set up is particularly beneficial in that all of the cards rather than having to be placed on the table or the like where they might be knocked over etc. are stored in region 47. This not only provides a neat and tidy placement of the cards but in addition, hides the front face of each of the cards at the front of the deck so that none of the players has a chance to preview any of the pictorial representations before the cards are actually played.

In the particular arrangement shown, card slot 41 opens directly to the card deck receiving region 47 so that the front card in the deck can simply be slid from region 47 along card slot 41 into the window region 45. The card after having been played is simply lifted up through the card slot 41 and placed at the back of the deck 12 so that the next card at the front of the deck can be slid across into the window region.

In the FIG. 2 arrangement, where the deck is simply placed on the table or the like, the deck further includes a separator card 28 which is nothing more than a blank card placed over the front face on the next card to be played from the deck. Accordingly, when the front card is removed from the deck to place it in the card support, the front face of the next card is not visible to the players, again hiding it until the card is actually in play.

Figure 7:
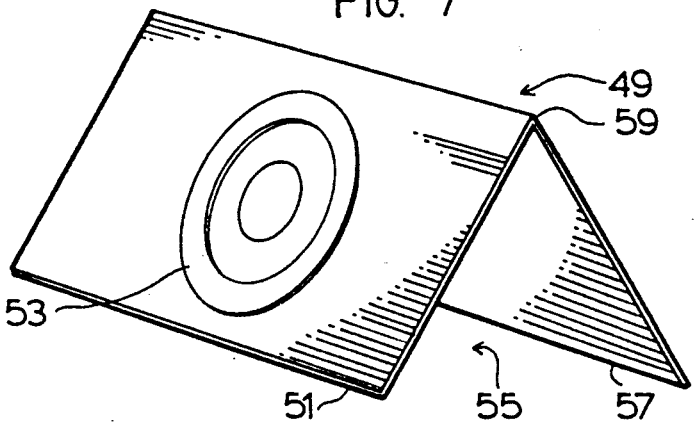
FIG. 7 is a perspective view of a further preferred embodiment card.

FIG. 7 of the drawings shows a modified embodiment of a card construction for use in playing the present game. In particular, the card has a tent construction comprising a front leg 51 and a rear leg 57 extending rearwardly away from the front leg. The front leg 51 is provided on its front face with the pictorial representation 53 and on its rear face generally indicated at 55 with the worded description of the pictorial representation which cannot be seen in FIG. 7. The rear leg 57 provides a support for the card to hold the front leg in a generally upright position and also provides a movable flap rearwardly of the front leg for covering the information on the rear face 55 of the front leg 51. Therefore, in this arrangement, it is the actual overall card construction which provides not only the game card but in addition, provides the support means for supporting the game card. Note that once again, the game card does not have to be "removed from the support means" to view the material on the rear face of the front leg but rather the rear leg which is foldably connected at fold line 59 to the front leg simply has to be folded upwardly so that all of the describers are then able to view the rear face of the front leg for playing as described above.

Figure 8:
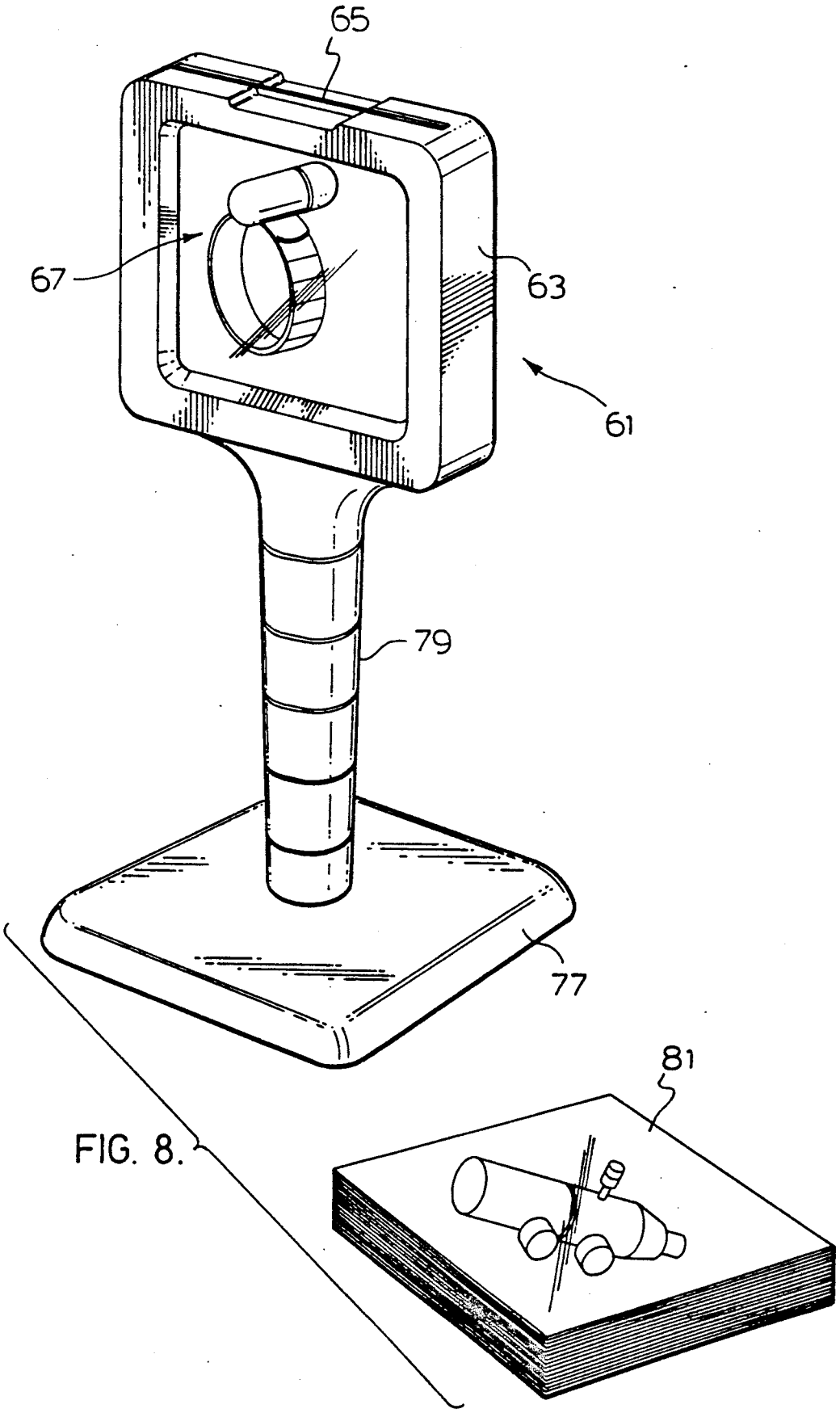
FIG. 8 is a perspective view of a card support and cards to be inserted in that support according to a further preferred embodiment of the present invention.
Figure 9:
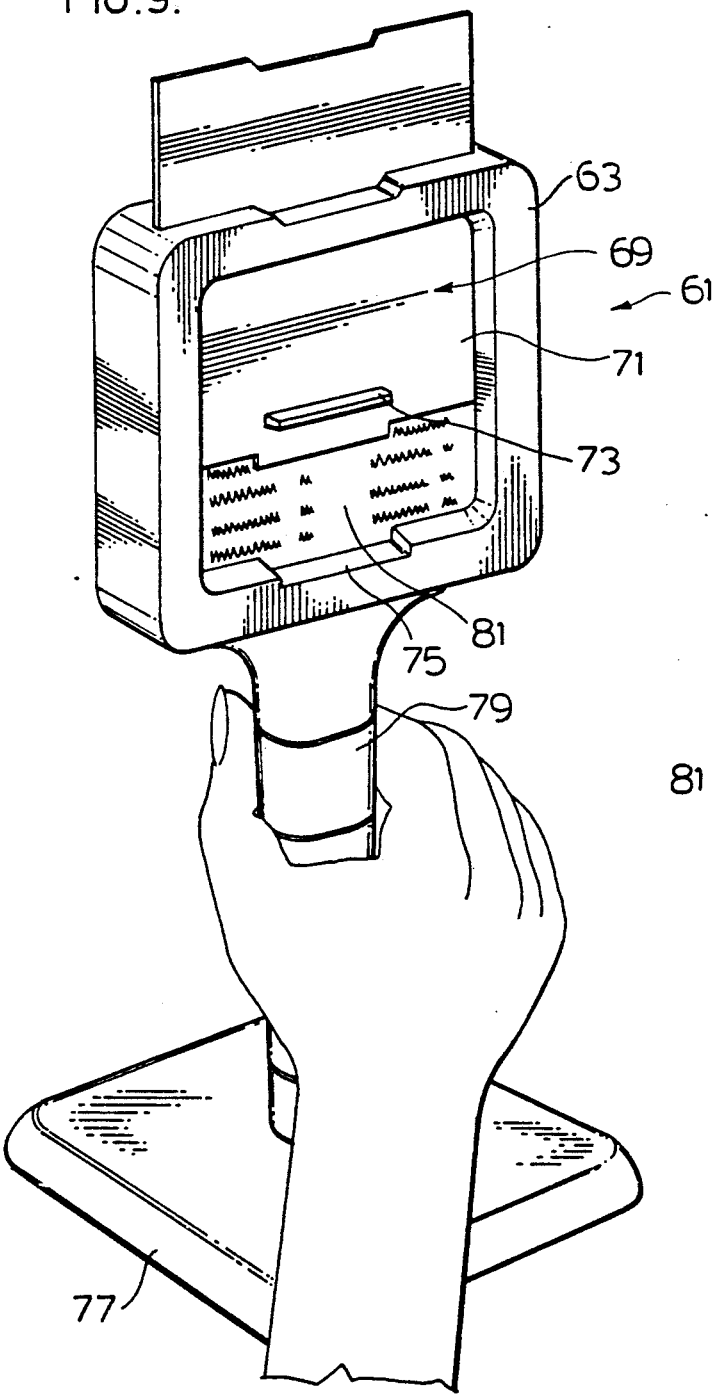
FIG. 9 is a rear perspective view of the card support of FIG. 8 with a card in position within the support.

FIG. 8 shows still a further preferred form of a card holder generally indicated at 61. This particular card holder includes an upper frame 63 having a top card insert slot 65. The front of the frame includes an open viewing area 67 while the rear of the frame as best seen in FIG. 9, includes a viewing area generally indicated at 69. This viewing area is selectively covered and uncovered by a movable sliding cover 71. Cover 71 includes a finger grip 73 with the frame 63 of the card holder being recessed at 75 to accommodate the fitting of finger grip 73 when in the down position. Cover 71, shown in FIGS. 9 and 10, can easily be slid upwardly to review the back of the card and then when released, automatically falls downward to hide the back of the card.

Figure 10:
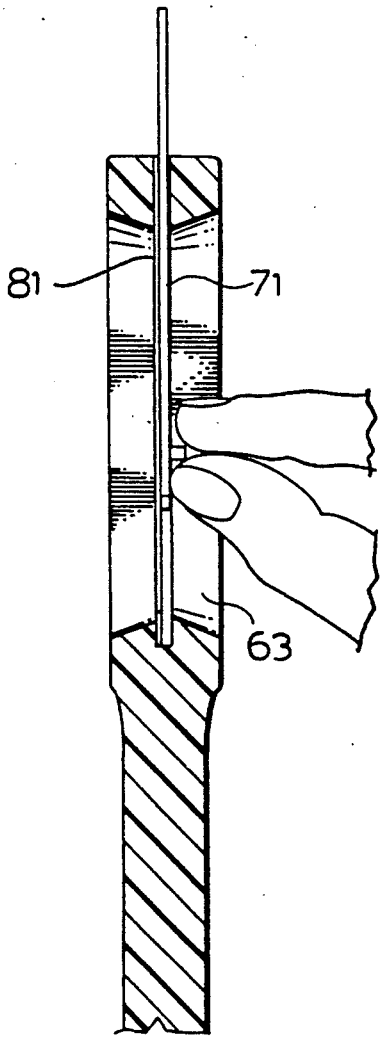
FIG. 10 is a sectional view from one side of the upper end of the card support FIG. 9.

In this particular arrangement, card holder 61 includes an enlarged base 77 and a narrow handle region 79. The handle region is elongated to elevate the upper frame 63 of the card holder such that one of the cards 81, shown in FIGS. 8, 9 and 10, is at a height that it can be easily viewed by the players of the game. This is a very beneficial feature, in that while the game is in play the players may place drinking glasses etc. on the table which will not interfere with the players' view of the card within the holder. The holder itself is dimensioned such that it locates the card at a height above most standard glass sizes.

Handle 79 is also beneficial for the fact that it allows the players i.e., the bluffers and the truth tellers, to pass the card holder from player to player and to grip the card holder around the handle with one hand, allowing the other hand to be used to raise cover 71 to view the back of the card.

In the descriptions for the earlier embodiments the player identification means to determine who is a bluffer and who is a truth teller is provided on the back of the card. FIGS. 11 and 12 show an alternate arrangement in which individual card like members generally indicated at 83 are used as player identification members. These identification members include a plurality of card-like members 85 and an individual card-like member 87. As seen in FIG. 12 of the drawings cards 85 and card 87 are identical on their upper surfaces while as seen in FIG. 11, cards 85 shows the word "bluffers" on their under surface while card 87 shows the word "truth teller" on its under surface. These cards are passed out, top side up, to all of the players except for the guesser for each new round of play. Each player will then know his or her particular function for that round but the guesser is not able to discern from the cards because of their identical top surfaces who is going to be a bluffer and who is going to be a truth teller.

This arrangement, over and above the earlier described embodiment where each card identifies the bluffer and the truth teller, has the added benefit that when a card is repeated, it may or may not be described by the same players as bluffers and truth teller depending upon how cards 83 are dealt to the players.

For durability purposes, card like members 83 are preferably made from a strong, unbendable, mar-resistant material, such as for example, a durable, relatively thick plastic material. As anyone who has played cards will appreciate when working with standard playing cards these can become bent and damaged in a manner such that an individual card is easily recognized according to the damage done to it. In the present case this would be very detrimental to play of the game and it is important that, as noted above, card-like members 83 be very durable so that the guesser is not able to ascertain because of some type of marking or bending, which card is a bluffer card and which card is a truth teller card.

FIG. 13 shows a further preferred embodiment of a score-keeping card 89. Each one of the players is provided with a card 89, which includes a plurality of openings 91. Scoring members 93 having small projections on their bases for fitting into openings 91, are provided to each player according to his or her performance in the game. Each time a player is awarded points a scoring member 93 is fitted into that particular player's scorecard 89 for keeping track of scoring in the game.

In order to minimize manufacturing costs and to maximize storage space, card 89 is preferably made from the same material and of the same shape and size as cards 85 and 87.

Although various preferred embodiments of the invention have been described in detail, it will be appreciated by those skilled in the art that variations may be made without departing from the spirit of the invention or the scope of the appended claims.

We claim:

1. Game apparatus comprising a plurality of game cards, each card having a front face and a rear face, the front face of each card having a pictorial representation thereon and the rear face having an accurate worded description of said pictorial representation, said game apparatus including card support means for supporting the cards individually in at least a generally upright position with the pictorial representation on the front face of each card in an exposed position and the worded description being viewable from the rear of said support means without having to remove the card from said support means and player identification means which identifies a specific player to provide a true statement of the accurate worded description on the card and which further identifies other players to provide untrue statements as to the accurate worded description on the card.

2. Game apparatus as claimed in claim 1, wherein said player identification means comprises a plurality of identification members which may be passed individually to different players in the game.

3. Game apparatus as claimed in claim 1, wherein said identification members comprise rigid plastic cards, all of which have an identical top surface and some of which have identical bottom surfaces and at least one of which has a bottom surface varied from said identical bottom surfaces.

4. Game apparatus as claimed in claim 1, wherein said card support means comprises an upright stand including an enlarged base, a center narrowed handle section and an enlarged head for receiving the card.

5. Game apparatus as claimed in claim 4, wherein said enlarged head of said card support means includes a vertically sliding rear cover.

* * * * *